US006588463B2

(12) United States Patent
Swan

(10) Patent No.: US 6,588,463 B2
(45) Date of Patent: Jul. 8, 2003

(54) DRIP CATCHER SYSTEM

(76) Inventor: Dana Swan, F.I. Products, 112 S. Monica Cir., Newbury Park, CA (US) 91320

( * ) Notice: Subject to any disclaimer, the term of this patent is extended or adjusted under 35 U.S.C. 154(b) by 0 days.

(21) Appl. No.: 09/909,625

(22) Filed: Jul. 19, 2001

(65) Prior Publication Data

US 2002/0007866 A1 Jan. 24, 2002

Related U.S. Application Data

(60) Provisional application No. 60/220,307, filed on Jul. 24, 2000.

(51) Int. Cl.[7] ..... B65B 1/04

(52) U.S. Cl. ..... 141/86; 141/106; 141/311 A; 141/364; 141/331

(58) Field of Search ..... 141/86, 106, 105, 141/311 A, 364, 331, 339, 340, 341, 342, 343; 248/316.3, 222.13; 184/106

(56) References Cited

U.S. PATENT DOCUMENTS

| | | | | |
|---|---|---|---|---|
| 225,530 | A | * | 3/1880 | McGlinchy |
| 298,233 | A | * | 5/1884 | Richards |
| 645,199 | A | | 3/1900 | Brooks |
| 1,603,641 | A | | 10/1926 | Richards |
| 2,132,056 | A | | 10/1938 | Tate |
| 2,174,093 | A | | 9/1939 | Perlman |
| 2,187,974 | A | | 1/1940 | Johnson |
| 2,200,024 | A | | 5/1940 | De Sipio et al. |
| D148,734 | S | | 2/1948 | Tackenberg et al. |
| D154,921 | S | | 8/1949 | Haffner |
| 2,780,081 | A | | 2/1957 | Alexander |
| 3,346,228 | A | * | 10/1967 | Thorman |
| 3,559,935 | A | * | 2/1971 | Gardner |
| 3,865,023 | A | | 2/1975 | Halvorsen |
| 4,245,666 | A | * | 1/1981 | Norris |
| D288,651 | S | | 3/1987 | Rimmeir |
| 4,706,720 | A | * | 11/1987 | Pattison et al. |
| 4,789,017 | A | | 12/1988 | Panasewicz et al. |
| D304,670 | S | | 11/1989 | Johnson |
| D341,520 | S | | 11/1993 | LaBelle |
| 5,293,912 | A | * | 3/1994 | Wildash et al. |
| D382,448 | S | | 8/1997 | Maique |
| 5,749,490 | A | | 5/1998 | Keicher |
| 6,199,804 | B1 | * | 3/2001 | Donofrio, Jr. |

* cited by examiner

*Primary Examiner*—Steven O. Douglas
*Assistant Examiner*—Khoa Huynh
(74) *Attorney, Agent, or Firm*—Gene Scott-Patent Law & Venture Group

(57) ABSTRACT

An oil drip catching apparatus includes a wall mounting bracket having a base portion adapted for attachment to a wall, a top portion, integral with the base portion and adapted for receiving an upper rim of a funnel, and a bottom portion, integral with the base portion and spaced apart from the top portion. A means for receiving a drip catching bottle in dowardly directed and adapted for removable engagement with the bottle. A spring is engaged with the bottom portion, and adapted for directing a spring force upwardly on the funnel, the Drips from the funnel are directed into the drip catching bottle.

12 Claims, 1 Drawing Sheet

DRIP CATCHER SYSTEM

The present invention claims the priority date of a prior filed provisional patent application having serial No. 60/220,307 and an official filing date of Jul. 24, 2000 and which discloses substantially similar matter as described herein.

BACKGROUND OF THE INVENTION

1. Field of the Invention

This invention relates generally to funnels and more particularly to a wall mount for receiving a funnel and a means for catching drips therefrom.

2. Description of Related Art

The following art defines the present state of this field:

Tackenberg et al., U.S. D148,734 provides a design for a holder for a coffee maker.

Haffner, U.S. D154,921 describes a holder for upper bowl of vacuum coffee brewing device design.

Rimmeir, U.S. D288,651 provides a design for a funnel apparatus for filling hollowed sandwich rolls.

Johnson, U.S. D304,670 describes a paint strainer holder design.

LaBelle, U.S. D341,520 describes a funnel support design.

Maique, U.S. D382,448 describes a funnel design.

Brooks, U.S. Pat. No. 645,199 describes a bag-holder, the combination of the vertical standard comprising a flat metallic bar having its lower end bent edgewise at a right angle, forming of said bent portion the base piece comprising a thin flat bar of considerable width whose sides stand vertically and whose thin edge is presented downwardly, the base-piece also comprising a thin flat bar united to and crossing said base-piece edgewise at righ angles with its edge presented downwardly, said base-pieces standing with their lower edges in the same horizontal plane, said vertical standard at its upper end having a portion bent horizontally, and an integral ring formed in said bent portion at the upper end of the standard projecting horizontally above said base, said ring having pins adapted to receive and hold the mouth of the bag.

Richards, U.S. Pat. No. 1,603,641 describes a vase holder comprising a frame including apportion having an eye at the upper-end thereof whereby the holder may be suspended from a support projecting from a wall, portions of said frame being extended laterally from said first mentioned portion for engagement with a wall to prevent the frame from rotating upon a support by which it is suspended, and a vase receiving ring including a pair of arms embracing the first mentioned portion of said frame and pivoted to the latter to permit the ring to be swung between a position at an angle to said frame and a position in the plane of said frame, the pivot of said ring being located adjacent to the laterally extending portions of said frame whereby said laterally extending portions constitute stops to limit swinging movement of said ring beyond a predetermined angular relation with respect to said frame.

Tate, U.S. Pat. No. 2,132,056 describes a coffee making funnel support, a single continuous piece of resilient material bent to form a loop portion adapted to receive the neck of a funnel, said support including an outwardly directed portion tangent to said loop portion, said material being bent to extend upwardly from said outwardly extending portion, said upwardly extending portion merging into a circular portion, said circular portion having its end free to move towards and from the upper end of the upwardly extending portion so that the diameter of the circle may vary, said circular portion having an outwardly extending radially arranged portion, said outwardly extending radially arranged portion having an end portion which extends downwardly parallel to the upwardly extending portion, said downwardly extending portion being flattened, said circular portion having a larger diameter than that of the loop portion.

Perlman, U.S. Pat. No. 2174,093 describes a rack comprising a vertical supporting member having perforated cross arm adapted to be attached to a vertical surface and provided with integral upper and lower horizontal supporting members for independently supporting in vertically spaced relation the upper and lower bowls of a glass coffee brewer, said upper supporting member being of annular form for receiving the funnel of the upper bowl, said lower supporting member comprising a ring coaxially arranged with respect to the upper supporting member and provided with a tray shaped to effect registration of the opening of the lower bowl therein with the funnel of an upper bowl on said upper supporting member and constituting a drip pan for catching drippings from the funnel of said upper bowl when the lower bowl has been removed therefrom.

Johnson, U.S. Pat. No. 2,187,974 describes a bracket for supporting coffee brewing vessels which have a container portion and a stem extending therefrom and surrounded by a gasket disposed on said stem, the combination of: a bracket body including a vertically extending portion and an upper bracket arm formed integrally therewith and extending substantially horizontally; an opening in said upper bracket arm; a skirt member extending about said opening and having a shape conforming with the external shape of the gasket on said stem for receiving said stem and engaging said gasket for supporting said coffee brewing vessel and maintaining said stem thereof in a substantially vertical position; a lower bracket arm formed integrally with said bracket body and spaced below said upper bracket arm a distance exceeding the length of said stem; a means on said lower bracket arm supporting a drip cup in vertical alignment with the lower end of said stem and spaced downwardly therefrom.

De Sipio et al., U.S. Pat. No. 2,200,024 describes a soap dispenser including a bracket having a projecting arm and retaining element above said arm, the arm being provided with means thereon to engage and lock a container cap, and an inverted container rotatably retained by said element and provided with a rotatable closure cap engaged and locked by said means for for rotatably supporting the container for turning movement to open or closed position.

Alexander, U.S. Pat. No. 2,780,081 describes a holder for a coffee maker top, a round flat bottom plate having an upper surface having a depression defining a drip basin therein, a round flat top plate overlying said bottom plate and having an underside, said top plate having a coffee maker top receiving opening, said opening and said basin being eccentrically positioned toward one side of the plates and vertically aligned with each other, a single vertical strut having upper and lower ends engaged respectively with the underside of the top plate and the upper surface of the bottom plate, said strut being located inwardly of the edges of the plates, and in the space between the plates at the other side from the basin and opening, and means securing the strut to the top and bottom plates.

Halvorsen, U.S. Pat. No. 3,865,023 describes and appliance for separating fat from the top of soup or broth or other similar kitchen chores. Upper and lower vessels are provided with a valve control arrangement in the upper vessel to control the leakage of the heavier component out of the bottom of the vessel into the lower vessel. To provide simple control in a sanitary environment that may be readily cleaned the upper vessel has its bottom slightly coned or funneled toward a center hole and a tapered rod is inserted into the hole to seal it. Thus the rod, which extends out of the upper vessel may be manually manipulated to control the speed and depth of separation, thus controlling turbulence.

Panasewicz et al., U.S. Pat. No. 4,789,017 describes funnels; more specifically to funnels intended for use with fluids used in engine compartments, such as in transportation vehicles. Examples of such fluids are crankcase oil, transmission fluid, anti-freeze or other coolant fluids, brake fluid, and power steering fluid. The invention is a liquid transfer system including a funnel with a dust cover that may be stored on a funnel support while the funnel is in use and that may include a piercing tool on its inner surface capable of puncturing the lids of containers used with the funnel. Also claimed is such a liquid transfer system including a support that holds the funnel in a vertical position during storage, a drip catcher, and an axially extendible and compressible spout.

Keicher, U.S. Pat. No. 5,749,490 describes an inexpensive hanger for a shampoo or other material dispensing bottle. The hanger comprises a thin web of material which preferably has one opening permitting it to be securely attached between the cap and body of the bottle with the neck received in the opening and another opening for hanging it on a hook on a wall. The web of material is selected to have sufficient rigidity or stiffness to allow the bottle to be hung with only one hand (which holds the body of the bottle) and to have sufficient flexibility to allow it to be deformed to lie alongside the bottle so that the hanger may be marketed attached to the bottle without the necessity of changing existing packaging for the bottle. The web alternatively has at one end an opening sized to receive the body of the bottle and at the other end an opening, preferably two openings of different sizes, to receive the bottle neck so that the bottle may be hung upside down.

The prior art teaches the use of funnel supports as in Tate and LaBelle but does not teach a spring loaded oil draining funnel support capable of excluding dust and debris during draining residual oil from the funnel after it has been used. The present invention fulfills these needs and provides further related advantages as described in the following summary.

SUMMARY OF THE INVENTION

The present invention teaches certain benefits in construction and use which give rise to the objectives described below.

An oil drip catching apparatus includes a wall mounting bracket having a base portion adapted for attachment to a wall, a top portion, integral with the base portion and adapted for receiving an upper rim of a funnel and fully covering it as a dust cover, and a bottom portion, integral with the base portion and spaced apart from the top portion. A means for receiving a drip catching bottle in downwardly directed and adapted for removable engagement with a bottle. A spring is engaged with the bottom portion, and adapted for directing a spring force upwardly on the funnel so as to keep an upper rim in contact with the top portion. The Drips from the funnel are directed into the drip catching bottle.

A primary objective of the present invention is to provide an apparatus and method of use of such apparatus that provides advantages not taught by the prior art.

Another objective is to provide such an invention capable of supporting an oil draining funnel.

A further objective is to provide such an invention capable of directing oil dripping from the oil draining funnel into a bottle for disposal or use.

A still further objective is to provide such an invention capable of keeping dust and other debris from falling into the funnel while the funnel is draining.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawing illustrates the present invention. In such drawing.

DETAILED DESCRIPTION OF THE INVENTION

Figure 1:
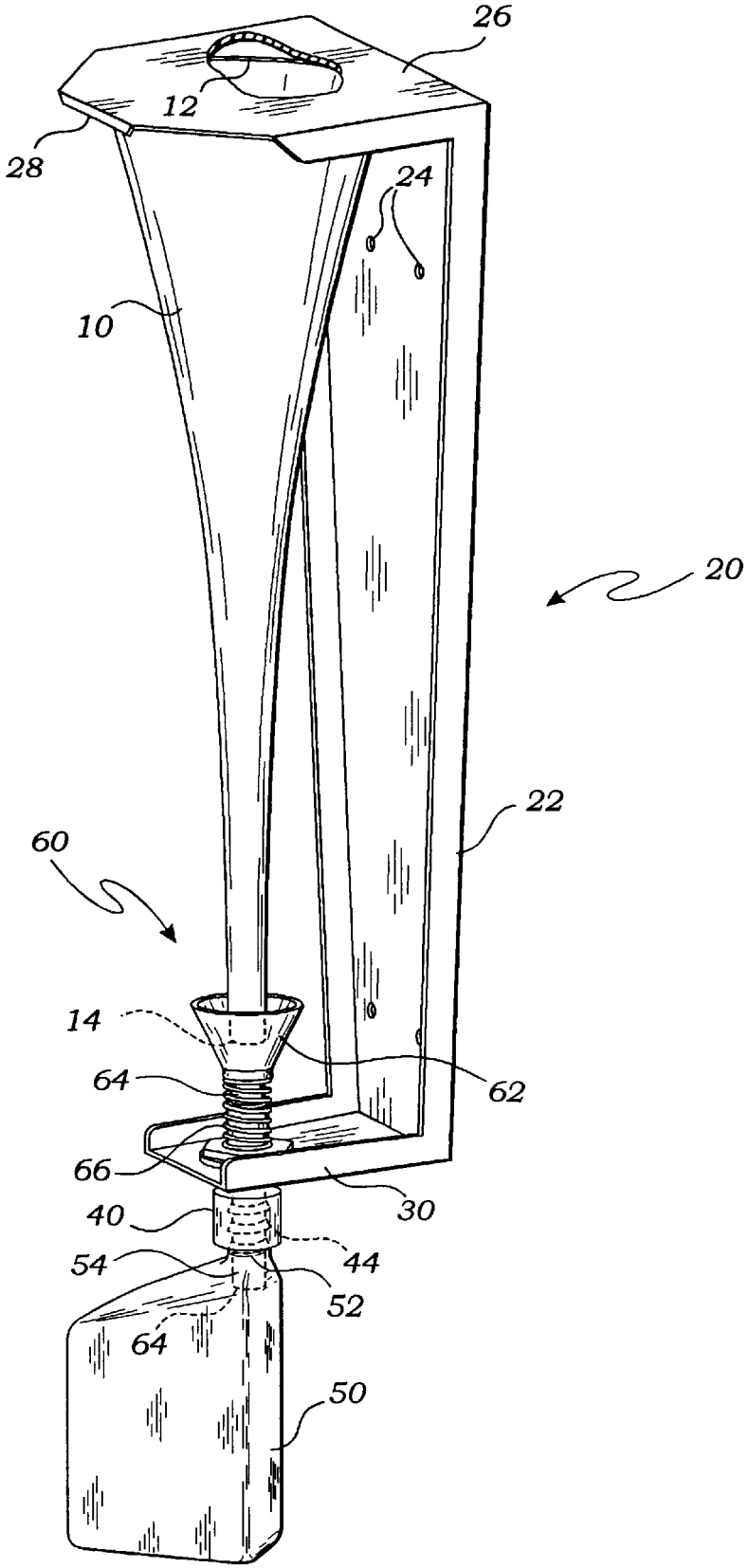
FIG. 1 is a perspective view of the preferred embodiment of the invention.

The above described drawing figures illustrate the invention in at least one of its preferred embodiments, which is further defined in detail in the following description.

The invention comprises a funnel 10 having an upper 12 and lower rims 14, and a mounting means 20, preferably a wall mounting bracket (bracket), preferably formed from a single piece of sheet metal or molded plastic. It is bent or shaped into a base portion 22 adapted, by mounting holes 24, for instance, for securement to a wall (not shown). The funnel 10 may be considered as a part of the invention, or may be considered as a work piece. A top portion 26 of the bracket 20 is integral with the base portion 22 and is adapted, by its size and flatness, for receiving the upper rim 12 of the funnel 10. The top portion 26 preferably provides a downwardly directed lip 28 for securing the funnel 10 from moving laterally. A bottom portion 30 of the bracket 20 is also integral with the base portion 22 and is spaced apart from the top portion 26. A means for receiving 40 a drip catching bottle 50 is engaged with and downwardly directed from the bottom portion 30 of the mounting bracket 20. It provides an internal screw thread 44 adapted for receiving a corresponding thread 52 on a neck 54 of the drip catching bottle 50 so as to mount the bottle 50 onto the apparatus. A spring biased means 60 is engaged with the bottom portion 30 and adapted, by its size and conformation, for receiving the lower rim 14 of the funnel 10. It comprises an upwardly directed cup portion 62 integral with a downwardly directed tubular portion 64 and a coil spring 66 encompassing the tubular portion 64. When the cup portion 62 is pressed downwardly, it compresses the spring 66 and therefore is adapted for directing a spring force upwardly on the funnel 10. The spring biased means 60 is further adapted, by its cup shaped portion 62 for receiving drips from the funnel 10, when the funnel is placed therein, and for directing the drips into the drip catching bottle 50 through the tubular portion 64 which extends into the bottle 50.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An drip catching apparatus comprising: a mounting means having a top portion, adapted for receiving an upper rim of a funnel, a bottom portion, spaced apart from the top portion said bottom portion having an upper surface and a lower surface, said lower surface having a bottle receiving means extended downwardly therein, a drip catching bottle in directed engagement with said bottle receiving means; said upper surface having a spring biased means, said spring biased means applying a spring force axially on the funnel for clamping the funnel between the top portion and the bottom portion of the mounting means, wherein the spring biased means further includes means adapted for receiving a lower rim of the funnel and for directing drips into the drip catching bottle.

2. The apparatus of claim 1 wherein the mounting means is formed from one piece of sheet metal.

3. The apparatus of claim 1 wherein the mounting means is formed from molded plastic.

4. The apparatus of claim 1 wherein the top portion provides a downwardly directed lip for securing the upper rim of the funnel therewithin.

5. The apparatus of claim 1 wherein the spring biased means comprises an upwardly directed cup portion integral with a downwardly directed tubular portion and a coil spring encompassing the tubular portion.

6. The apparatus of claim 1 wherein the bottle receiving means provides an internal screw thread adapted for receiving a corresponding thread on a neck of the drip catching bottle.

7. An drip catching apparatus in combination with a funnel having an upper rim and a lower rim comprising: a mounting means having a top portion, receiving the upper rim of the funnel, a bottom portion, spaced apart from the top portion said bottom portion having an upper surface and a lower surface, said lower surface having a bottle receiving means extended downwardly therein, a drip catching bottle in directed engagement with said bottle receiving means; said upper surface having a spring biased means, said spring biased means applying a spring force axially on the funnel thereby clamping the funnel between the top portion and the bottom portion of the mounting means, wherein the spring biased means further includes means for receiving the lower rim of the funnel and for directing drips into the drip catching bottle.

8. The combination of claim 7 wherein the mounting means is formed from one piece of sheet metal.

9. The combination of claim 7 wherein the mounting means is formed from molded plastic.

10. The combination of claim 7 wherein the top portion provides a downwardly directed lip for securing the upper rim of the funnel therewithin.

11. The combination of claim 7 wherein the spring biased means comprises an upwardly directed cup portion integral with a downwardly directed tubular portion and a coil spring encompassing the tubular portion.

12. The combination of claim 7 wherein the bottle receiving means provides an internal screw thread adapted for receiving a corresponding thread on a neck of the drip catching bottle.

* * * * *